US008941576B2

(12) United States Patent
Kang et al.

(10) Patent No.: US 8,941,576 B2
(45) Date of Patent: Jan. 27, 2015

(54) DISPLAY PANEL INCLUDING DUAL GATE THIN FILM TRANSISTOR

(75) Inventors: Shin Tack Kang, Yongin-si (KR); Kyung-Hee Kim, Seoul (KR); Beom Jun Kim, Seoul (KR); Sung Man Kim, Seoul (KR); Jong Hwan Lee, Anyang-si (KR); Hong Woo Lee, Asan-si (KR); Hye Rhee Han, Suwon-si (KR); Ji Hye Heo, Cheonan-si (KR)

(73) Assignee: Samsung Display Co., Ltd. (KR)

( * ) Notice: Subject to any disclaimer, the term of this patent is extended or adjusted under 35 U.S.C. 154(b) by 291 days.

(21) Appl. No.: 13/429,871

(22) Filed: Mar. 26, 2012

(65) Prior Publication Data

US 2013/0113772 A1 May 9, 2013

(30) Foreign Application Priority Data

Nov. 4, 2011 (KR) ..... 10-2011-0114746

(51) Int. Cl.

*G09G 3/36* (2006.01)
*G09G 5/00* (2006.01)
*G09G 3/20* (2006.01)

(52) U.S. Cl.

CPC ..... *G09G 3/3674* (2013.01); *G09G 3/20* (2013.01); *G09G 2300/0408* (2013.01); *G09G 2310/0267* (2013.01); *G09G 2310/0286* (2013.01); *G09G 2310/0289* (2013.01); *G09G 2310/0291* (2013.01); *G09G 2320/045* (2013.01)

USPC ..... 345/100; 345/204

(58) Field of Classification Search

CPC ..... G09G 3/3674; G09G 2310/0286

USPC ..... 345/100, 204

See application file for complete search history.

(56) References Cited

U.S. PATENT DOCUMENTS

| | | | |
|---|---|---|---|
| 6,653,699 | B1 | 11/2003 | Yang |
| 6,703,672 | B1 | 3/2004 | Brigham et al. |
| 6,891,916 | B2 | 5/2005 | Park et al. |
| 7,101,740 | B2 | 9/2006 | Young |
| 7,135,365 | B2 | 11/2006 | Liu et al. |
| 7,233,308 | B2 | 6/2007 | Park |
| 7,310,402 | B2 | 12/2007 | Wei et al. |
| 7,432,906 | B2 | 10/2008 | Nakajima et al. |
| 7,443,245 | B2 | 10/2008 | Tsurumaki et al. |
| 7,466,312 | B2 | 12/2008 | Choi et al. |
| 7,538,848 | B2 | 5/2009 | Park et al. |
| 7,592,270 | B2 | 9/2009 | Teo et al. |
| 7,595,783 | B2 | 9/2009 | Cho et al. |
| 7,629,851 | B2 | 12/2009 | Tsurumaki et al. |

(Continued)

FOREIGN PATENT DOCUMENTS

| | | |
|---|---|---|
| JP | 4069648 | 1/2008 |
| KR | 100525740 | 10/2005 |
| KR | 1020070023267 | 2/2007 |

*Primary Examiner* — Claire X Pappas
*Assistant Examiner* — Robert Stone
(74) *Attorney, Agent, or Firm* — Cantor Colburn LLP

(57) ABSTRACT

A display panel includes a gate driver connected to a gate line, where the gate driver includes a plurality of stages, where each of the stages includes at least one dual gate thin film transistor having a first control terminal and a second control terminal, and where each of the stages receives a clock signal, a first low voltage, a second low voltage, at least one transmission signal of previous stages, at least two transmission signals of subsequent stages and an output control signal from one of the stages to output a gate voltage including a gate-on voltage and a gate-off voltage.

17 Claims, 14 Drawing Sheets

(56) References Cited

U.S. PATENT DOCUMENTS

| | | | | |
|---|---|---|---|---|
| 7,852,305 | B2 | 12/2010 | Tsai | |
| 8,026,990 | B2 | 9/2011 | Hwang et al. | |
| 2003/0227433 | A1* | 12/2003 | Moon | 345/100 |
| 2004/0077160 | A1 | 4/2004 | Singh | |
| 2004/0227718 | A1* | 11/2004 | Park | 345/100 |
| 2005/0158671 | A1 | 7/2005 | Shimizu et al. | |
| 2007/0296681 | A1* | 12/2007 | Kim et al. | 345/100 |
| 2008/0001904 | A1* | 1/2008 | Kim et al. | 345/100 |
| 2008/0024480 | A1 | 1/2008 | Jee et al. | |
| 2008/0187089 | A1 | 8/2008 | Miyayama et al. | |
| 2009/0040203 | A1* | 2/2009 | Kim et al. | 345/204 |
| 2009/0189839 | A1 | 7/2009 | Ko et al. | |
| 2010/0033415 | A1 | 2/2010 | Bae et al. | |
| 2010/0231492 | A1* | 9/2010 | Moon et al. | 345/87 |
| 2010/0277206 | A1* | 11/2010 | Lee et al. | 327/108 |
| 2010/0302230 | A1* | 12/2010 | Moon et al. | 345/212 |
| 2011/0122117 | A1 | 5/2011 | Lee et al. | |
| 2011/0134355 | A1 | 6/2011 | Yi | |
| 2011/0141074 | A1 | 6/2011 | Koo | |

* cited by examiner

FIG.7A

| | -1H | 0H (gate chargingH) |
|---|---|---|
| Q node level | charge<br>TR4<br>(n-1)TR15 | Leakage<br>①TR10<br>(Vgs=4V,Vds=56(50+6)V)<br>②TR9,6<br>(Vgs=4V,Vds=63(50+13)V)<br>③TR4<br>(Vgs=0V,Vds=63(50+13)V |
| Gate off output | TR1<br>G : TR4,11<br>S : CK_low | - |
| Carry output | TR15<br>G : Qnode<br>Out : CK_low | TR15<br>G : Qnode<br>Out : CK_high |
| Inverter output | Output selection1 : CK<br>Output selection2 : Vss1<br>an output selection 1 or 2 is determined according to IN<br>(IN off : 1 selection)<br>(IN on : 2 selection)<br>IN1 : TR15 CK_low<br>IN2 : TR17 Vss2<br>Carry : CK_low<br>IN : Vss2<br>Out : CK_low | IN1 : TR15 CK_high<br>IN2 : TR17 leakage Vss2<br>Carry : CK_high<br>IN : CK_high<br>Out : Vss1 |

FIG.7B

| | 1H | 2H (4H,6H…) | 3H (5H,7H…) |
|---|---|---|---|
| Q node level | Reset<br>TR9 (+TR16)<br>G : g (n+1)<br>S : Vss2 | Hold<br>①TR10<br>G : IVT_high(CK)<br>S : Vss2<br>②TR6<br>G : g(n+2)<br>S : Vss2 | - |
| Gate off output | TR2, TR14, *TR1<br>G : g(n+1)<br>S : Vss<br>*TR1 an itself role is important | TR3<br>G : inverter(≒CK)<br>S : Vss | - |
| Carry output | TR17<br>G : g(n+1)<br>Out : Vss2 | TR11<br>G : IVT_high<br>Out : Vss2 | Low |
| Inverter output | IN1 : TR15-(off)<br>IN2 : TR17 leakage Vss2<br>Carry : Vss2<br>IN : Vss2<br>Out : CK_low | IN1 : TR15-(off) TR11_Vss2<br>IN2 : TR17 leakage Vss2<br>Carry : Vss2<br>IN : Vss2<br>Out : CK_high | IN1 : TR15 leakage<br>IN2 : TR17 leakage Vss2<br>Carry : -<br>IN : Vss2<br>Out : CK_low |

DISPLAY PANEL INCLUDING DUAL GATE THIN FILM TRANSISTOR

This application claims priority to Korean Patent Application No. 10-2011-0114746, filed on Nov. 4, 2011, and all the benefits accruing therefrom under U.S.C. §119, the content of which in its entirety is herein incorporated by reference.

BACKGROUND OF THE INVENTION (a) Field of the Invention

Exemplary embodiments of the invention relate to a display panel, and more particularly, to a display panel having a gate driver integrated in the display panel.

(b) Description of the Related Art

A liquid crystal display is one of the most widely used types of display device. The liquid crystal display typically includes two display panels, on which field generating electrodes, e.g., pixel electrodes and a common electrode, are provided, and a liquid crystal layer that is interposed between the display panels. The liquid crystal display applies voltages to the field generating electrodes to generate an electric field in the liquid crystal layer, which in turn determines the alignment of liquid crystal molecules of the liquid crystal layer and thus the polarization of incident light, such that an image is displayed. The display device may include an organic light emitting device, a plasma display device, an electrophoretic display and the liquid crystal display, for example.

This display device typically includes a gate driver and a data driver. In the display device, the gate driver may be integrated on a display panel thereof by being patterned along with a gate line, a data line and a thin film transistor thereof. When the gate driver is integrated on the display panel, an additional gate driving chip may be omitted, and manufacturing costs thereof are thereby reduced. However, the thin film transistor inside the integrated gate driver may generate a leakage current to some degree while the gate-off signal is output such that the output is deteriorated, and the level of the gate voltage is thereby deteriorated. The possibility of the current leakage occurrence may increase in an environment of high temperature or low temperature. Also, the gate-on voltage may be delayed by capacitance and resistance of the gate line of the display panel such that the gate-on voltage may be delayed to a gate-off voltage, and a transverse line defect thereby occurs in a display screen.

BRIEF SUMMARY OF THE INVENTION

According to exemplary embodiments of the invention, a decrease of a level of a gate-on voltage output from a gate driver integrated with a display panel and a delay of timing, at which the gate-on voltage is changed into a gate-off voltage, are effectively prevented.

An exemplary embodiment of a display panel includes a gate driver connected to a gate line, where the gate driver includes a plurality of stages, where each of the stages includes at least one dual gate thin film transistor having a first control terminal and a second control terminal, and where each of the stages receives a clock signal, a first low voltage, a second low voltage, at least one transmission signal of previous stages, at least two transmission signals of subsequent stages and an output control signal from one of the stages to output a gate voltage including a gate-on voltage and a gate-off voltage.

In an exemplary embodiment, the output control signal may have a low voltage during a corresponding period, and a corresponding stage, which receives the output control signal, may output the gate-on voltage during the period.

In an exemplary embodiment, the output control signal may have the low voltage during a previous period of the corresponding period, and the corresponding stage may output the gate-on voltage during the previous period.

In an exemplary embodiment, each of the stages may include an input section, a pull-up driver, a pull-down driver, an output unit and a transmission signal generator, each of the stages may receive the first low voltage and the second low voltage, which is lower than the first low voltage, and output the first low voltage as the gate-off voltage, the input section, the pull-down driver, the output unit and the transmission signal generator may be connected to a first node, and the pull-up driver and the pull-down driver may be connected to a second node, which generates an inverter signal.

In an exemplary embodiment, the output unit may include a transistor and outputs the gate-on voltage, a control terminal of the transistor of the output unit may be connected to the first node, the at least one dual gate thin film transistor may include a first dual gate thin film transistor, and the first dual gate thin film transistor may be connected to the first node.

In an exemplary embodiment, the output control signal may be the inverter signal of one of the previous stages.

In an exemplary embodiment, a first control terminal of the first dual gate thin film transistor may receive a carry signal of one of the subsequent stages, a second control terminal of the first dual gate thin film transistor may receive the inverter signal of the one of the previous stages, and an input terminal of the dual gate thin film transistor may be connected to the first node.

In an exemplary embodiment, the at least one dual gate thin film transistor may further include a second dual gate thin film transistor, a first control terminal and an input terminal of the second dual gate thin film transistor may be connected to an output terminal of the first dual gate thin film transistor, a second control terminal of the second dual gate thin film transistor may receive the inverter signal of the one of the previous stages, and an output terminal of the second dual gate thin film transistor may receive the second low voltage.

In an exemplary embodiment, the output control signal may be the inverter signal of a corresponding stage, which receives the output control signal.

In an exemplary embodiment, an input terminal of the first dual gate thin film transistor may be connected to the first node, an output terminal of the first dual gate thin film transistor may receive the second low voltage, and a first control terminal and a second control terminal of the first dual gate thin film transistor may receive the inverter signal of the corresponding stage.

In an exemplary embodiment, the at least one dual gate thin film transistor may further include a second dual gate thin film transistor, a first control terminal of the second dual gate thin film transistor may receive a transmission signal of one of the subsequent stages, a second control terminal of the second dual gate thin film transistor may receive the inverter signal of the corresponding stage, an output terminal of the second dual gate thin film transistor may receive the second low voltage, and an input terminal of the second dual gate thin film transistor may be connected to the first node.

In an exemplary embodiment, each of the stages may include first to fourth input terminals, a clock input terminal, a first voltage input terminal which receives the first low voltage, a second voltage input terminal which receives the second low voltage, which is lower than the first low voltage, a gate voltage output terminal which outputs the gate voltage, a transmission signal output terminal, and an inverter signal output terminal connected to the fourth input terminal of one of the subsequent stages.

In an exemplary embodiment, each of the stages may further include a first node connected to a control terminal of a thin film transistor thereof, which outputs the gate-on voltage, and a second node, which outputs an inverter signal.

In an exemplary embodiment, the at least one dual gate thin film transistor may include a first dual gate thin film transistor, a first control terminal of the first dual gate thin film transistor may receive a carry signal of the one of the subsequent stages, a second control terminal of the first dual gate thin film transistor may receive the inverter signal of one of the previous stages, and an input terminal of the first dual gate thin film transistor may be connected to the first node.

In an exemplary embodiment, the at least one dual gate thin film transistor may further include a second dual gate thin film transistor, a first control terminal and an input terminal of the second dual gate thin film transistor may be connected to an output terminal of the first dual gate thin film transistor, a second control terminal of the second dual gate thin film transistor may receive the inverter signal of the one of the previous stages, and an output terminal of the second dual gate thin film transistor may receive the second low voltage.

In an exemplary embodiment, at least one dual gate thin film transistor may include a first dual gate thin film transistor, an input terminal of the first dual gate thin film transistor may be connected to the first node, an output terminal of the first dual gate thin film transistor may receive the second low voltage, and a first control terminal and a second control terminal of the first dual gate thin film transistor may receive the inverter signal of a corresponding stage thereof.

In an exemplary embodiment, at least one dual gate thin film transistor further may include a second dual gate thin film transistor, a first control terminal of the second dual gate thin film transistor may receive a transmission signal of another of the subsequent stages, a second control terminal of the second dual gate thin film transistor may receive the inverter signal of the corresponding stage thereof, an output terminal of the second dual gate thin film transistor may receive the second low voltage, and an input terminal of the second dual gate thin film transistor may be connected to the first node.

In an exemplary embodiment, a portion of the transistors of the gate driver integrated in the display panel have dual gate structure to be controlled by an inverter signal of a previous stage thereof such that the level of the gate-on voltage output from the gate driver is effectively prevented from being decreased or the timing change to the gate-off voltage is effectively prevented from being delayed. In an alternative exemplary embodiment, the dual gate transistor of the integrated gate driver may be controlled by the inverter signal generated therein such that the level of the gate-on voltage output from the gate driver is effectively prevented from being decreased or the timing change to the gate-off voltage is effectively prevented from being delayed.

BRIEF DESCRIPTION OF THE DRAWINGS

The above and other features will become more apparent by describing in further detail exemplary embodiments thereof with reference to the accompanying drawings, in which:

FIGS. 7A and 7B are tables showing an operation characteristic of the signals in an exemplary embodiment of a stage of a gate driver according to the invention;

DETAILED DESCRIPTION OF THE INVENTION

Figure 1:
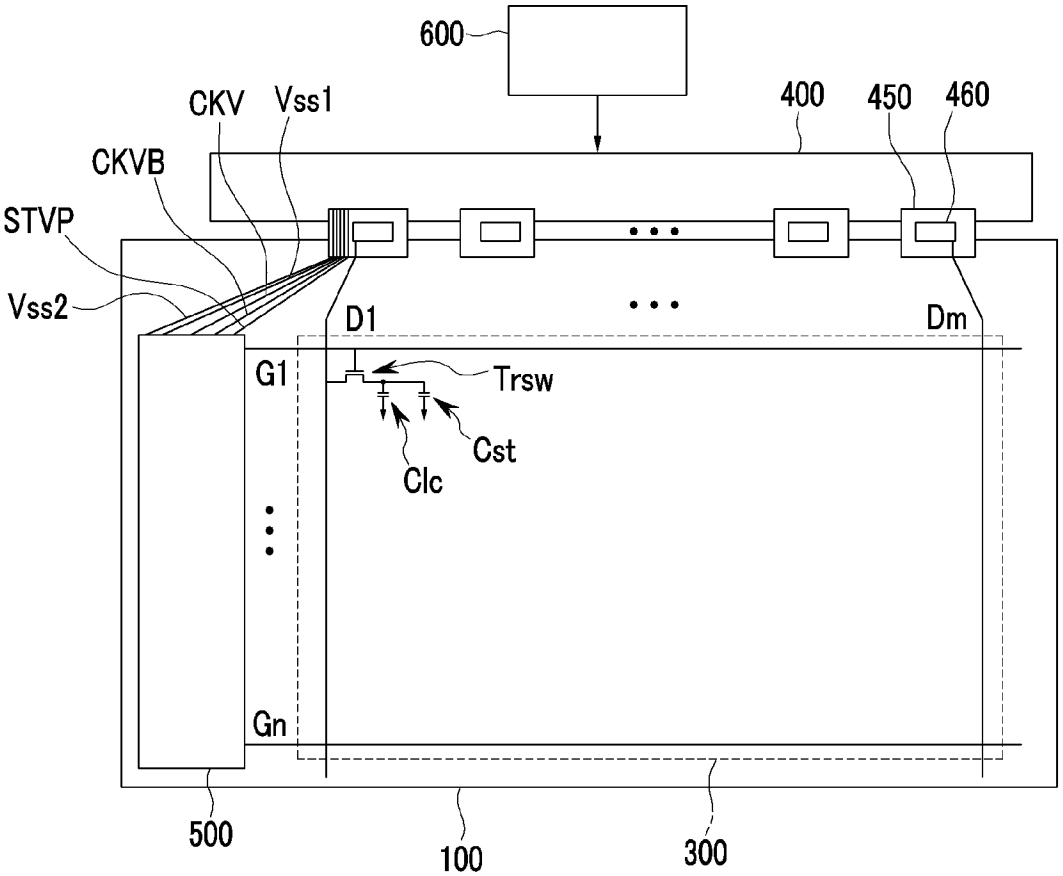
FIG. 1 is a top plan view of an exemplary embodiment of a display panel according to the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims set forth herein.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

Hereinafter, exemplary embodiments of a display device will be described with reference to the accompanying drawings.

FIG. 1 is a block diagram showing an exemplary embodiment of a display device according to the invention.

Referring to FIG. 1, an exemplary embodiment of a display panel 100 includes a display area 300, which displays images, and a gate driver 500, which applies a gate voltage to a gate line of the display area 300. A data line of the display area 300 receives a data voltage from a data driver integrated circuit ("IC") 460 on a film, e.g., a flexible printed circuit ("FPC") film 450, attached to the display panel 100. The gate driver 500 and the data driver IC 460 are controlled by a signal controller 600. A printed circuit board ("PCB") is disposed outside the film, e.g., the FPC film 450, to transmit the signal from the signal controller 600 to the data driver IC 460 and the gate driver 500. The signal controller 600 may output various signals, e.g., a first clock signal CKV, a second clock signal CKVB, a scan start signal STVP and a signal having predetermined low voltage including first and second low voltages Vss1 and Vss2. In an alternative exemplary embodiment, the signal having the predetermined low voltage may include a single low voltage.

In an exemplary embodiment, the display area 300 is a liquid crystal panel, and the display area 300 includes a thin film transistor Trsw, a liquid crystal capacitor Clc and a storage capacitor Cst, as shown FIG. 1. In an alternative exemplary embodiment, the display area 300 is an organic light emitting panel, and the display area 300 includes a thin film transistor and an organic light emitting diode. In another alternative exemplary embodiment, the display area 300 may be other display panels including elements such as a thin film transistor. Hereinafter, an exemplary embodiment where the display area 300 is a liquid crystal panel will be described for convenience of description, but the invention is not limited thereto.

The display area 300 includes a plurality of gate lines, e.g., first to n-th gate lines G1 to Gn, and a plurality of data lines, e.g., first to m-th data lines D1 to Dm, which are insulated from each other and crossing each other. The display area 300 may include a plurality of pixels connected to the gate lines and the data lines.

In an exemplary embodiment, each of the pixels includes a thin film transistor Trsw, a liquid crystal capacitor Clc and a storage capacitor Cst. A control terminal of the thin film transistor Trsw is connected to a corresponding gate line, an input terminal of the thin film transistor Trsw is connected to a corresponding data line, and an output terminal of the thin film transistor Trsw is connected to a first terminal of the liquid crystal capacitor Clc and a first terminal of the storage capacitor Cst. A second terminal of the liquid crystal capacitor Clc is connected to a common electrode, and a second terminal of the storage capacitor Cst is applied with a storage voltage Vest from the signal controller 600. In an exemplary embodiment, the structure of the pixel of the liquid crystal panel is not limited to the illustrated exemplary embodiment in FIG. 1. In an alternative exemplary embodiment, a pixel may further include an additional constitution.

The data lines D1 to Dm receive the data voltage from the data driver IC 460, and the gate lines G1 to Gn receive the gate voltage from the gate driver 500.

In an exemplary embodiment, the data driver IC 460 is provided at upper and lower sides of the display panel 100 and is connected to the data lines D1 to Dm extending in a vertical direction. In an alternative exemplary embodiment, as shown in FIG. 1, the data driver IC 460 is provided at the upper side of the display panel 100.

The gate driver 500 receives the first and second clock signals CKV and CKVB, the scan start signal STVP, the first low voltage Vss1 corresponding to a gate-off voltage, and the second low voltage Vss2, which is lower than the gate-off voltage, to generate a gate voltage (e.g., the gate-on voltage and the gate-off voltage), and sequentially applies the gate-on voltage to the gate lines G1 to Gn.

The first and second clock signals CKV and CKVB, the scan start signal STVP, the first low voltage Vss1 and the second low voltage Vss2 are applied to the gate driver 500 through the film 450 positioned substantially close to the gate driver, as shown in FIG. 1. In an exemplary embodiment, the first and second clock signals CKV and CKVB, the scan start signal STVP, the first low voltage Vss1 and the second low voltage Vss2 are external signals. In an alternative exemplary embodiment, the first and second clock signals CKV and CKVB, the scan start signal STVP, the first low voltage Vss1 and the second low voltage Vss2 may be transmitted to the film 450, e.g., the FPC film, through PCB 400 from the signal controller 600.

Next, an exemplary embodiment of the gate driver 500 and the gate lines G1 to Gn will be described.

Figure 2:
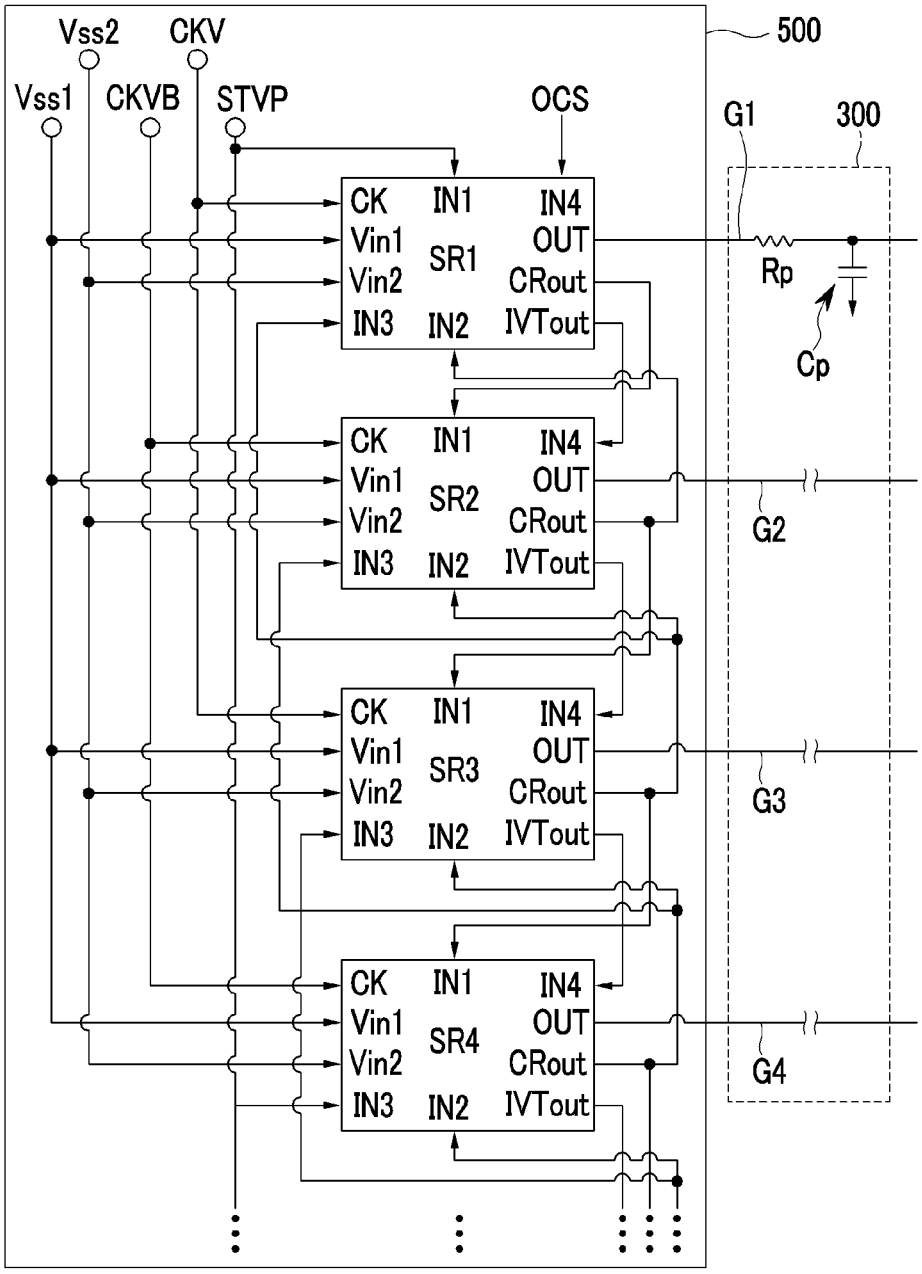
FIG. 2 is a block diagram showing an exemplary embodiment of a gate driver and a gate line of FIG. 1.

FIG. 2 is a block diagram showing an exemplary embodiment of the gate driver and the gate lines.

In an exemplary embodiment, as shown in FIG. 1, the display area 300 includes the gate lines G1 to Gn, the liquid crystal capacitor and the storage capacitor Cst. In such an embodiment, each of the gate lines G1 to Gn, the liquid crystal capacitor Clc and the storage capacitor Cst has a resistance and a capacitance, and the sums thereof are respectively represented as a resistance Rp and a capacitance Cp. As shown in FIG. 2, each of the gate lines and pixels connected thereto may be collectively represented as the resistor Rp and the capacitor Cp in a circuit diagram. These values of the resistor Rp and the capacitor Cp are whole values for one gate line, and may determined based on the structure and the characteristics of the display area 300. The gate voltage output from a stage is transmitted to a corresponding gate line.

Next, an exemplary embodiment of the gate driver 500 will be described.

The gate driver 500 includes a plurality of stages, e.g., a first stage SR1, a second stage SR2, a third stage SR3 and a fourth stage SR4, for example, that are dependently connected to each other. Each of the stages SR1, SR2, SR3 and SR4 includes four input terminals, e.g., a first input terminal IN1, a second input terminal IN2, a third input terminal IN3 and a fourth input terminal IN4, a clock input terminal CK, two voltage input terminals, e.g., a first voltage input terminal Vin1 and a second voltage input terminal Vin2, a gate voltage output terminal OUT that outputs the gate voltage, a transmission signal output terminal CRout and an inverter signal output terminal IVTout.

In an exemplary embodiment, the first input terminal IN1 of a stage is connected to the transmission signal output terminal CRout of a previous stage such that the stage receives the transmission signal CR of the previous stage. In such an embodiment, the first stage, which does not have a previous stage, receives the scan start signal STVP through the first input terminal IN1 thereof.

The second input terminal IN2 of the stage is connected to the transmission signal output terminal CRout of a first subsequent stage such that the stage receives the transmission signal CR of the first subsequent stage. The third input terminal IN3 of the stage is connected to the transmission signal output terminal CRout of a second subsequent stage such that the stage receives the transmission signal CR of the second subsequent stage.

Each of an (n−1)-th stage SR(n−1) (not shown) connected to an (n−1)-th gate line Gn−1 and an n-th stage SRn (not shown) connected to the n-th gate line Gn may be connected to a dummy stages to receive the transmission signal CR from the subsequent stages thereof. In an exemplary embodiment, an (n+1)-th stage SR(n+1) and a (n+2)-th stage SR(n+2) (not shown) are dummy stages that generate and output a dummy gate voltage. In such an embodiment, the gate voltage outputs from the first to n-th stages SR1 to SRn are transmitted through the gate lines such that the data voltage is applied to the pixels to display images, while the dummy stages, e.g., the (n+1)-th and (n+2)-th stages SR(n+1) and SR(n+2), may not be connected to the gate lines. In an alternative exemplary embodiment, the dummy stages are connected to the gate lines of dummy pixels (not shown) that do not display the image.

In an exemplary embodiment, the fourth input terminal IN4 is connected to an inverter signal output terminal IVTout of the previous stage such that the stage receives the inverter signal IVT of the previous stage. In such an embodiment, the first stage, which does not have the previous stage, receives an external signal. In an alternative exemplary embodiment, the first stage may receive a signal generated from the dummy stages SR(n+1) and SR(n+2) (not shown) at a predetermined timing. In an exemplary embodiment, the signal input to the fourth input terminal IN4 of the first stage may have the second low voltage Vss2 during a first horizontal period 1H, in which the first gate line G1 is applied with the gate-on voltage, and have a high voltage of the transmission signal CR, e.g., about 20 volts (V), but not being limited thereto, during a subsequent horizontal period. In an alternative exemplary embodiment, the first low voltage Vss1 instead of the second low voltage Vss2 may be applied to the fourth input terminal IN4 of the first stage, and the gate-on voltage instead of the high voltage of the transmission signal CR may be applied to the fourth input terminal IN4 of the first stage. In an exemplary embodiment, a signal having timing for a low voltage Vss1 or Vss2 to be applied to a stage during a horizontal period, in which the gate-on voltage is applied to the stage, is referred to as an output control signal OCS, and the output control signal OCS may have the high voltage (the high voltage of the transmission signal CR or the gate-on voltage) during a subsequent horizontal period after the gate-on voltage is applied thereto. Hereafter, an exemplary embodiment, where the inverter signal IVT of a stage is the signal having the characteristic of the output control signal OCS, will be described for convenience of description, but the invention is not limited thereto.

The clock terminal CK of the stage is applied with a clock signal. In an exemplary embodiment, the clock terminals CK of the odd-numbered stages of the stages are applied with the first clock signal CKV, and the clock terminals CK of the even-numbered stages of the stages are applied with the second clock signal CKVB. In such an embodiment, a phase of the first clock signal CKV and a phase of the second clock signal CKVB are substantially opposite to each other.

The first voltage input terminal Vin1 of the stage is applied with the first low voltage Vss1 corresponding to the gate-off voltage, and the second voltage input terminal Vin2 of the stage is applied with the second low voltage Vss2 that is lower than the first low voltage Vss1. In an exemplary embodiment, the voltage values of the first low voltage Vss1 and the second low voltage Vss2 may vary. In one exemplary embodiment, for example, the first low voltage Vss1 is about −6 V and the second low voltage Vss2 is about −10 V, in which the second low voltage Vss2 is a lower voltage than the first low voltage Vss1.

The operation of an exemplary embodiment of the gate driver 500 will now be described.

In an exemplary embodiment, the first stage SR1 receives the first clock signal CKV from outside through the clock input terminal CK thereof, receives the scan start signal STVP through the first input terminal IN1 thereof, receives the first and second low voltages Vss1 and Vss2 through the first and second voltage input terminals Vin1 and Vin2 thereof, receives the transmission signals CR, provided from the second stage SR2 and the third stage SR3, respectively, through the second and third input terminals IN2 and IN3 thereof, and receives the output control signal OCS through the fourth input terminal IN4 thereof such that the gate-on voltage is output to the first gate line through the gate voltage output terminal OUT thereof. In such an embodiment, the transmission signal output terminal CRout outputs the transmission signal CR, and the transmission signal CR output from the first stage SR1 is transmitted to the first input terminal IN1 of the second stage SR2, and the inverter signal IVT, which is output from the inverter signal output terminal IVTout of the first stage SR1, is transmitted to the fourth input terminal IN4 of the second stage SR2.

The second stage SR2 receives the second clock signal CKVB provided from outside through the clock input terminal CK thereof, receives the transmission signal CR of the first stage SR1 through the first input terminal IN1 thereof, receives the first and second low voltages Vss1 and Vss2 through the first and second voltage input terminals Vin1 and Vin2 thereof, receives the transmission signals CR, provided from the third stage SR3 and the fourth stage SR4, respectively, through the second and third input terminals IN2 and IN3 thereof, and receives the inverter signal IVT provided from the first stage SR1 through the fourth input terminal IN4 thereof such that the gate-on voltage is output to the second gate line through the gate voltage output terminal OUT of the second stage SR2. The transmission signal CR is output through the transmission signal output terminal CRout of the second stage SR2 and transmitted to the first input terminal IN1 of the third stage SR3 and the second input terminal IN2 of the first stage SR1. The inverter signal IVT is output from the inverter signal output terminal IVTout of the second stage SR2 and transmitted to the fourth input terminal IN4 of the third stage SR3.

The third stage SR3 receives the first clock signal CKV provided from outside through the clock input terminal CK thereof, receives the transmission signal CR of the second stage SR2 through the first input terminal IN1 thereof, receives the first and second low voltages Vss1 and Vss2 through the first and second voltage input terminals Vin1 and Vin2 thereof, receives the transmission signals CR provided from the fourth stage SR4 and the fifth stage SR5, respectively, through the second and third input terminals IN2 and IN3 thereof, and receives the inverter signal IVT provided from the second stage SR2 through the fourth input terminal IN4 thereof such that the gate-on voltage is output to the third gate line through the gate voltage output terminal OUT of the third stage SR3. The transmission signal CR is output through the transmission signal output terminal CRout of the third stage SR3 and transmitted to the first input terminal IN1 of the fourth stage SR4, the third input terminal IN3 of the first stage SR1 and the second input terminal IN2 of the second stage SR2. The inverter signal IVT is output from the inverter signal output terminal IVTout of the third stage SR3 and transmitted to the fourth input terminal IN4 of the fourth stage SR4.

In an exemplary embodiment, the n-th stage SRn receives the second clock signal CKVB provided from outside through the clock input terminal CK thereof, receives the transmission signal CR of the (n−1)-th stage SR2 through the first input terminal IN1 thereof, receives the first and second low voltages Vss1 and Vss2 through the first and second voltage input terminals Vin1 and Vin2 thereof, receives the transmission signals CR provided from the (n+1)-th stage SR(n+1) (the dummy stage) and the (n+2)-th stage SR(n+2) (the dummy stage), respectively, through the second and third input terminals IN2 and IN3 receives, and receives the inverter signal IVT provided from the (n−1)-th stage SRn−1 through the fourth input terminal IN4 thereof such that the gate-on voltage is output to the n-th gate line through the gate voltage output terminal OUT of the n-th stage SRn. The transmission signal CR is output through the transmission signal output terminal CRout of the n-th stage SRn and transmitted to the first input terminal IN1 of the (n+1)-th stage SR(n+1) (the dummy stage), the third input terminal IN3 of the (n−2)-th stage SR(n−2) and the second input terminal IN2 of the (n−1)-th stage SR(n−1). The inverter signal IVT is output from the inverter signal output terminal IVTout of the n-th stage SRn and transmitted to the (n+1)-th stage SRn+1 (the dummy stage).

The connection structure of the stages of an exemplary embodiment of the gate driver 500 has been described with reference to FIG. 2. Next, a structure of an exemplary embodiment of a stage of a gate driver connected to one gate line will be described in further detail with reference to FIG. 3.

Figure 3:
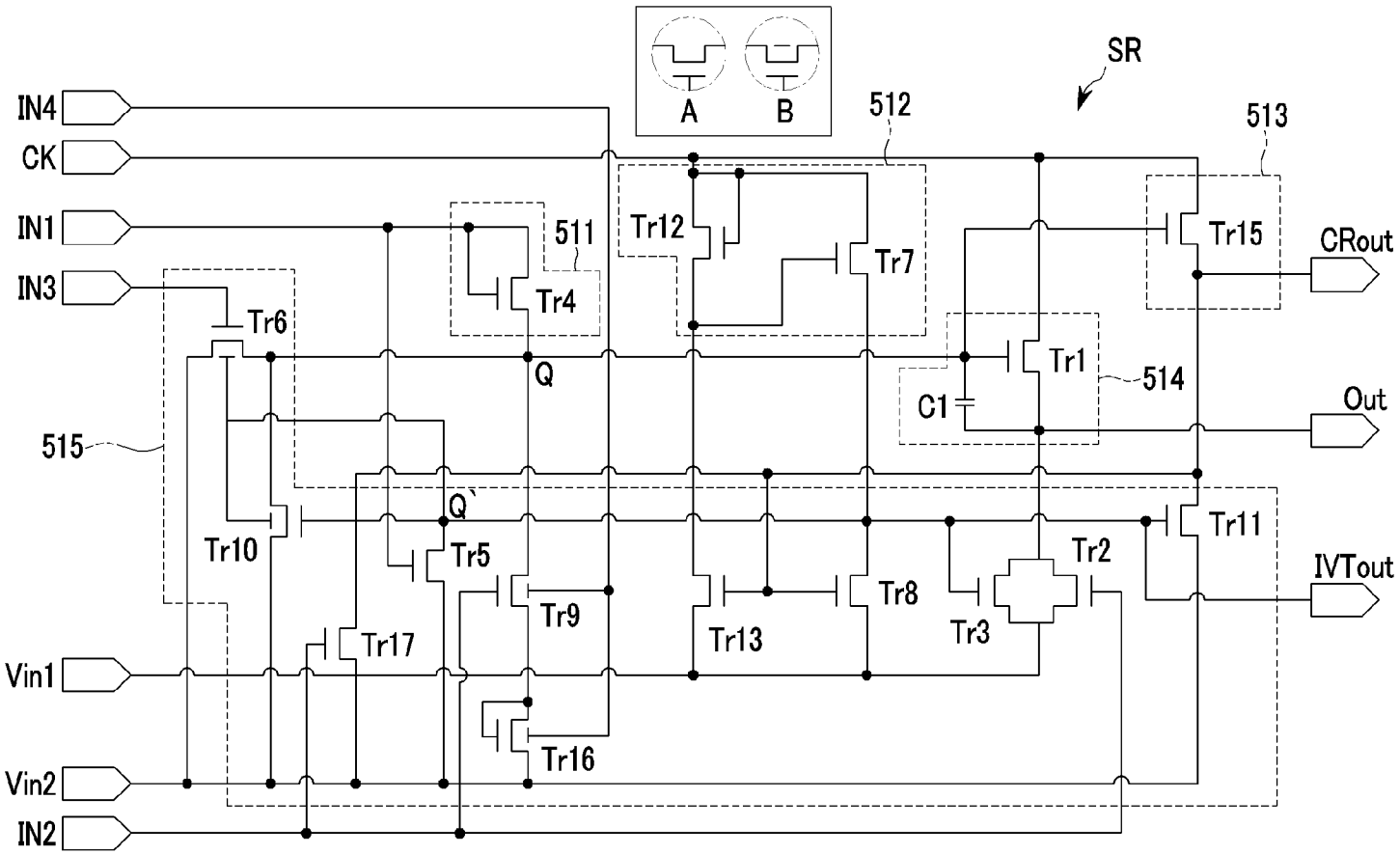
FIG. 3 is a circuit diagram showing an exemplary embodiment of a stage in a gate driver according to the invention.
Figure 4:
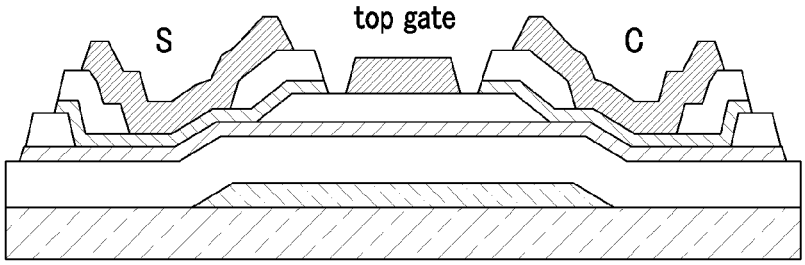
FIG. 4 is a cross-sectional view of an exemplary embodiment of a thin film transistor in a stage of a gate driver according to the invention.
Figure 5:
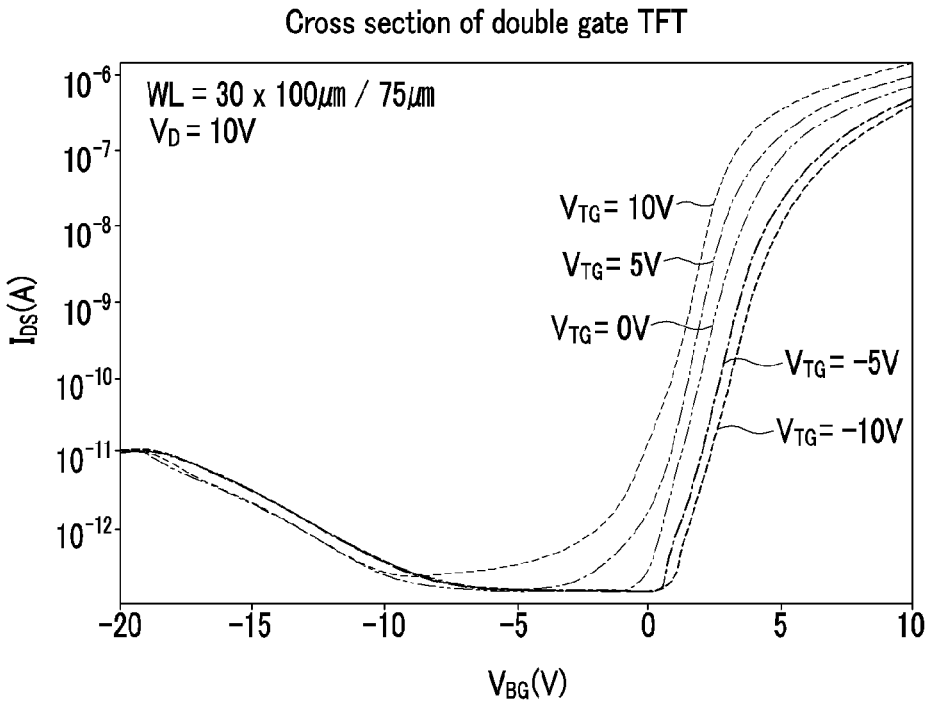
FIG. 5 is a graph of current between the source and the drain (ampere) versus voltage in a lower gate (volt) of the thin film transistor of FIG. 4.

FIG. 3 is an enlarged circuit diagram shown an exemplary embodiment of a stage in a gate driver according to the invention, FIG. 4 is a cross-sectional view of a thin film transistor in an exemplary embodiment of a stage of a gate driver according to the invention, and FIG. 5 is a graph of current between the source and the drain (ampere) versus voltage in a lower gate (volt) of the thin film transistor of FIG. 4.

In an exemplary embodiment, the stage of FIG. 3 includes a plurality of transistors, e.g., first to seventeen transistors Tr1 to Tr17. In an exemplary embodiment, the transistors in the stage may be one of two types of thin film transistor. In such an embodiment, the stage may include a thin film transistor of type-A and a thin film transistor of type-B as shown in FIG. 3. In such an embodiment, the thin film transistor of type-A may include a control terminal (a gate), an input terminal (a source), and an output terminal (a drain). In such an embodiment, the thin film transistor of type-B may be a dual gate thin film transistor having two gates as the control terminal thereof. In such an embodiment, as shown in FIG. 4, the thin film transistor of type-B includes one input terminal (source), one output terminal (drain), and upper and lower gates as the control terminals thereof. In an exemplary embodiment of FIG. 3, the sixth, ninth, tenth, and sixteenth thin film transistors Tr6, Tr9, Tr10 and Tr16 in the stage may be the transistor of type-B, e.g., a dual gate thin film transistor.

FIG. 5 is a graph of the current $I_{DS}$ between the source and the drain versus the voltage $V_{BG}$ in the lower gate (hereinafter referred to as the first control terminal) and the voltage $V_{TG}$ in the upper gate (hereinafter referred to as the second control terminal) in a dual gate thin film transistor. Referring to FIG. 5, the dual gate thin film transistor is turned on and off based on the voltage change at the lower gate (the first control terminal) and the voltage change of the upper gate (the second control terminal).

Referring to FIG. 3, an exemplary embodiment of a stage SR of the gate driver 500 includes an input section 511, a pull-up driver 512, a transmission signal generator 513, an output unit 514 and a pull-down driver 515. In an exemplary embodiment, a portion of the transistors of the pull-down driver 515 may be the dual gate thin film transistor (the thin film transistor of type-B).

The input section 511 includes one transistor (e.g., the fourth transistor Tr4), the input terminal and the control terminal of the fourth transistor Tr4 are commonly connected (e.g., diode-connected) to the first input terminal IN1, and the output terminal of the fourth transistor Tr4 is connected to a first node (hereinafter, referred to as a "node Q"). The input section 511 may transmit the high voltage to the node Q when the first input terminal IN1 is applied with the high voltage.

The pull-up driver 512 includes two transistors (e.g., the seventh transistor Tr7 and the twelfth transistor Tr12). In an exemplary embodiment, the control terminal and the input terminal of the twelfth transistor Tr12 are diode-connected and receive the first clock signal CKV or the second clock signal CKVB through the clock terminal CK, and the output terminal of the twelfth transistor Tr12 is connected to the control terminal of the seventh transistor Tr7 and the pull-down driver 515. In such an embodiment, the input terminal of the seventh transistor Tr7 is connected to the clock terminal CK, and the output terminal of the seventh transistor Tr7 is connected to a second node (hereinafter, referred to as a node Q') and thereby connected to the pull-down driver 515 via the Q' node. The control terminal of the seventh transistor Tr7 is connected to the output terminal of the twelfth transistor Tr12 and the pull-down driver 515. In such an embodiment, a parasitic capacitance may be formed between the input terminal and the control terminal of the seventh transistor Tr7, and a parasitic capacitance may be formed between the control terminal and the output terminal of the seventh transistor Tr7. When the pull-up driver 512 is applied with the high signal at the clock terminal CK, the high signal is transmitted to the control terminal of the seventh transistor Tr7 and the pull-down driver 515 through the twelfth transistor Tr12. The high signal transmitted to the seventh transistor Tr7 turns on the seventh transistor Tr7 such that the high signal applied from the clock terminal CK is applied to the node Q'. The signal of the node Q' is the inverter signal IVT and is transmitted to a subsequent stage through the inverter signal output terminal IVTout. In such an embodiment, the inverter signal IVT of a previous stage has characteristics of the output control signal OCS.

The transmission signal generator 513 includes one transistor (e.g., the fifteenth transistor Tr15). The input terminal of the fifteenth transistor Tr15 is connected to the clock terminal CK and receives the first clock signal CKV or the second clock signal CKVB, the control terminal of the fifteenth transistor Tr15 is connected to the output terminal of the input section 511, that is, the node Q, and the output terminal of the fifteenth transistor Tr15 is connected to the transmission signal output terminal CRout, which outputs the transmission signal CR. In such an embodiment, a parasitic capacitance (not shown) may be formed between the control terminal and the output terminal of the fifteenth transistor Tr15. The output terminal of the fifteenth transistor Tr15 is connected to the pull-down driver 515 to receive the second low voltage Vss2 such that the voltage value corresponding to a low level of the transmission signal CR is the second low voltage Vss2.

The output section 514 includes one transistor (e.g., the first transistor Tr1) and a capacitor (e.g., a first capacitor C1). The control terminal of the first transistor Tr1 is connected to the node Q, the input terminal of the first transistor Tr1 receives the first clock signal CKV or the second clock signal CKVB through the clock terminal CK, the first capacitor C1 is formed between the control terminal and the output terminal of the first transistor Tr1, and the output terminal of the first transistor Tr1 is connected to the gate voltage output terminal OUT. In such an embodiment, the output terminal of the first transistor Tr1 is connected to the pull-down driver 515 to receive the first low voltage Vss1 such that the value of the voltage corresponding to the gate-off voltage is the first low voltage Vss1. The output section 514 outputs the gate voltage based on the voltage of the node Q and the first clock signal CKV.

The pull-down driver 515 includes the thin film transistors of type-B (e.g., the dual gate thin film transistors), and removes charges remaining at the stage SR as a portion to smoothly output the gate-off voltage and the low voltage of the transmission signal CR such that the potential of the node Q, the potential of the node Q', the voltage output to the transmission signal CR and the voltage output to the gate line is substantially lowered. The pull-down driver 515 include eleven transistors (e.g., the second transistor Tr2, the third transistor Tr3, the fifth transistor Tr5, the sixth transistor Tr6, the eighth to eleventh transistors Tr8 to Tr11, the thirteenth transistor Tr13, the sixteenth transistor Tr16 and the seventeenth transistor Tr17).

Hereinafter, the transistors that pull down the node Q will be described. In such an embodiment, the transistors that pull down the node Q are the sixth transistor Tr6, the ninth transistor Tr9, the tenth transistor Tr10 and the sixteenth transistor Tr16, each of which is the dual gate thin film transistor (the thin film transistor of type-B). In an alternative exemplary embodiment, only the sixteenth transistor Tr16 is the dual gate thin film transistor, and the sixteenth transistor Tr16 may be diode connected.

In an exemplary embodiment, the first control terminal of the sixth transistor Tr6 is connected to the third input terminal IN3 such that the transmission signal CR of the second subsequent stage of the stage SR is applied to the first control terminal of the sixth transistor Tr6, the second control terminal of the sixth transistor Tr6 is connected to the node Q' to receive the inverter signal of the stage SR, the output terminal of the sixth transistor Tr6 is connected to the second voltage input terminal Vin2 to receive the second low voltage Vss2, and the input terminal of the sixth transistor Tr6 is connected to the node Q. In such an embodiment, the sixth transistor Tr6 is turned on based on the transmission signal CR applied from the second subsequent stage or the signal (e.g., the inverter signal) of the node Q' such that the voltage of the node Q is lowered to the second low voltage Vss2.

In an exemplary embodiment, the ninth transistor Tr9 and the sixteenth transistor Tr16 operate together to pull down the node Q. In such an embodiment, the control terminal of the ninth transistor Tr9 is connected to the second input terminal IN2 to receive the carry signal of the first subsequent stage of the stage SR, the second control terminal is connected to the fourth input terminal IN4 to receive the inverter signal IVT of the previous stage, the input terminal of the ninth transistor Tr9 is connected to the node Q, and the output terminal of the ninth transistor Tr9 is connected to the input terminal and the control terminal of the sixteenth transistor Tr16

The control terminal and the input terminal of the sixteenth transistor Tr16 are diode-connected to the output terminal of the ninth transistor Tr9, the second control terminal of the sixteenth transistor Tr16 is connected to the fourth input terminal IN4, and the output terminal of the sixteenth transistor Tr16 is connected to the second voltage input terminal Vin2 to receive the second low voltage Vss2. Therefore, the ninth transistor Tr9 and the sixteenth transistor Tr16 are turned on based on the transmission signal CR applied from the first subsequent stage or the inverter signal IVT of the previous stage such that the voltage of the node Q is lowered to the second low voltage Vss2.

The input terminal of the tenth transistor Tr10 is connected to the node Q, the output terminal of the tenth transistor Tr10 is connected to the second voltage input terminal Vin2 to receive the second low voltage Vss2, and the first control terminal and the second control terminal of the tenth transistor Tr10 are connected to the node Q' (the inverter signal) to receive the inverter signal of the stage SR. In such an embodiment, the tenth transistor Tr10 continuously lowers the voltage of the node Q to the second low voltage Vss2 when the inverter signal IVT of the node Q' has the high voltage, and does not lower the voltage of the node Q when the voltage of the node Q' is the low voltage. In such an embodiment, when the voltage of the node Q is not lowered, the stage SR outputs the gate-on voltage and the transmission signal CR.

Figure 6:
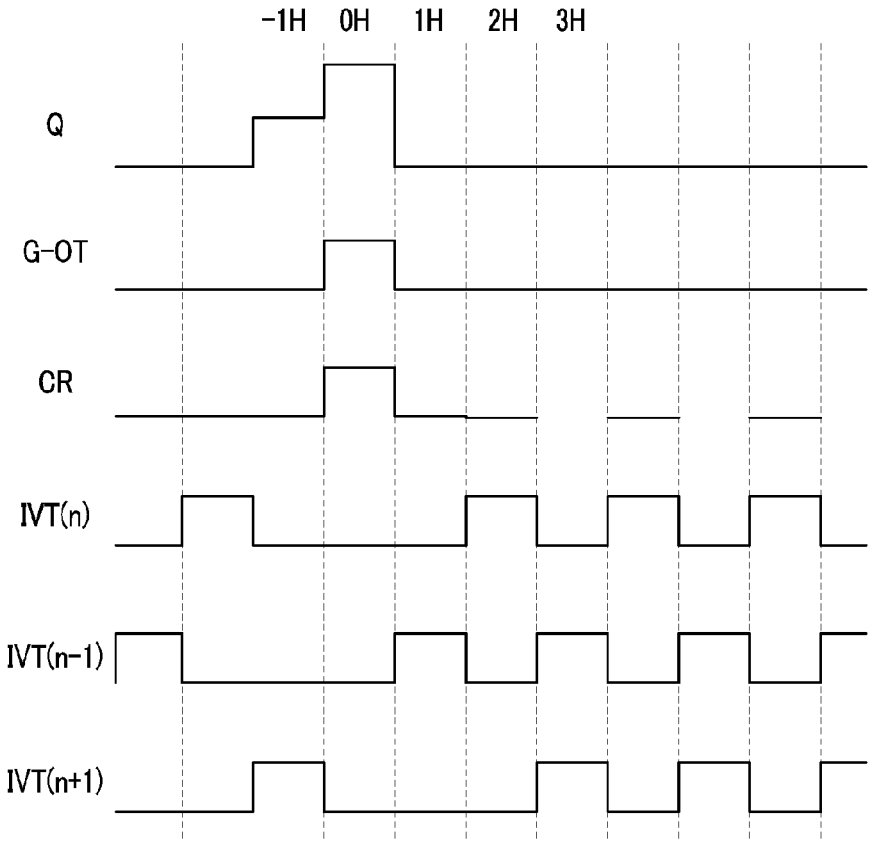
FIG. 6 is a signal timing diagram showing signals in an exemplary embodiment of a stage of a gate driver according to the invention.

In an exemplary embodiment, the transistors that pull down the node Q are the dual gate thin film transistor, and includes the ninth and sixteenth transistors Tr9 and Tr16 that transmit the inverter signal IVT of the previous stage to the second control terminal and the sixth and tenth transistors Tr6 and Tr10 connected to the node Q' of the stage SR to transmit the inverter signal IVT of the stage SR to the second control terminal. The inverter signal IVT is shown in FIG. 6 and the signal and the operation will be described later in detail with reference to FIG. 6.

The transistors that pull down the node Q' (the inverter signal) in the pull-down driver 515 will now be described. In an exemplary embodiment, the transistors that pull down the node Q' are the fifth transistor Tr5, the eighth transistor Tr8 and the thirteenth transistor Tr13.

The control terminal of the fifth transistor Tr5 is connected to the first input terminal IN1, the input terminal of the fifth transistor Tr5 is connected to the node Q', and the output terminal of the fifth transistor Tr5 is connected to the second voltage input terminal Vin2 such that the fifth transistor Tr5 lowers the voltage of the node Q' to the second low voltage Vss2 based on the transmission signal CR of the previous stage.

In an exemplary embodiment, the eighth transistor Tr8 has the control terminal connected to the transmission signal output terminal CRout of the corresponding stage, the input terminal connected to the node Q', and the output terminal connected to the first voltage input terminal Vin1. In such an embodiment, the eighth transistor Tr8 lowers the voltage of the node Q' to the first low voltage Vss1 based on the transmission signal CR of the stage SR.

In an exemplary embodiment, the thirteenth transistor Tr13 has the control terminal connected to the transmission signal output terminal CRout of the stage SR, the input terminal connected to the output terminal of the twelfth transistor Tr12 of the pull-up driver 512, and the output terminal connected to the first voltage input terminal Vin1. In such an embodiment, the thirteenth transistor Tr13 lowers the inner potential of the pull-up driver 512 to the first low voltage Vss1 and lowers the voltage of the node Q' connected to the pull-up driver 512 to the first low voltage Vss1 based on the transmission signal CR of the stage SR. In an exemplary embodiment, the thirteenth transistor Tr13 may discharge the inner charges of the pull-up driver 512 to first voltage input terminal Vin1, while the voltage of the node Q' is not pulled up due to the pull-up driver 512 connected to the node Q', such that the thirteenth transistor Tr13 indirectly lowers the voltage of the node Q' to the first low voltage Vss1.

The transistors that decrease the voltage output to the transmission signal CR in the pull-down driver 515 will now be described. In an exemplary embodiment, the transistors that decrease the voltage output to the transmission signal CR is the eleventh transistor Tr11 and the seventeenth transistor Tr17.

The eleventh transistor Tr11 has the control terminal connected to the node Q', the input terminal connected to the transmission signal output terminal CRout, and the output terminal connected to the second voltage input terminal Vin2. In such an embodiment, when the voltage of the node Q' is high, the voltage of the transmission signal output terminal CRout is lowered to the second low voltage Vss2 such that the transmission signal CR output form the stage SR is changed to the low level.

In an exemplary embodiment, the stage SR may further include the seventeenth transistor Tr17. The seventeenth transistor may include the control terminal connected to the second input terminal IN2, the input terminal connected to the transmission signal output terminal CRout, and the output terminal connected to the second voltage input terminal Vin2 such that the seventeenth transistor Tr17 lowers the voltage of the transmission signal output terminal CRout to the second low voltage Vss2 based on the transmission signal CR of the first subsequent stage. The seventeenth transistor Tr17 may operate based on the transmission signal CR of the first subsequent stage to assist the operation of the eleventh transistor Tr11.

The transistors that decreases the voltage output to the gate line from the pull-down driver 515 will now be described. In an exemplary embodiment, the transistors that decreasing the voltage output to the gate line are the second transistor Tr2 and the third transistor Tr3.

The second transistor Tr2 has the control terminal connected to the second input terminal IN2, the input terminal connected to the gate voltage output terminal OUT, and the output terminal connected to the first voltage input terminal Vin1. In such an embodiment, the gate voltage, which is output when the transmission signal CR of the first subsequent stage is output, is changed to the first low voltage Vss1.

The third transistor Tr3 has the control terminal connected to the node Q', the input terminal connected to the gate voltage output terminal OUT, and the output terminal connected to the first voltage input terminal Vin1. In such an embodiment, the gate voltage, which is output when the voltage of the node Q' is high, is changed to the first low voltage Vss1.

In the pull-down driver 515, the voltage of the gate voltage output terminal OUT is lowered to the first low voltage Vss1, and the voltage of the node Q, the node Q' and the transmission signal output terminal CRout are lowered to the second low voltage Vss2, which is lower than the first low voltage Vss1. In such an embodiment, when the gate-on voltage and the high voltage of the transmission signal CR may be substantially the same, the gate-off voltage and the low voltage of the transmission signal CR may be different from each other, e.g., the gate-off voltage is the first low voltage Vss1 and the low voltage of the transmission signal CR is the second low voltage Vss2.

In an exemplary embodiment, the gate voltage and the transmission signal CR may have predetermined voltage values. In one exemplary embodiment, the gate-on voltage may be about 25 V, the gate-off voltage and the first low voltage Vss1 may be about −5 V, the high voltage of the transmission signal CR may be about 25 V, and the low voltage and the second low voltage Vss2 may be about −10 V, for example, but not being limited thereto.

In an exemplary embodiment, the transmission signal generator 513 and the output unit 514 operate based on the voltage of the node Q such that the stage SR outputs the high voltage of the transmission signal CR and the gate-on voltage, such that the transmission signal CR is lowered from the high voltage to the second low voltage Vss2 based on the transmission signals CR of the previous stage and the first and second subsequent stages, and the gate-on voltage is lowered to the first low voltage Vss1 corresponding to the gate-off voltage. In such an embodiment, the voltage of the node Q in the stage SR is lower to the second low voltage Vss2 by the transmission signal CR of the second subsequent stage as well as by the transmission signal CR of the first subsequent stage to reduce the power consumption, and the second low voltage Vss2 is lower than the first low voltage Vss1, which is the gate-off voltage, such that a current leakage in the transistors of the stage is effectively prevented due to substantially lowered second low voltage when the voltage is changed by the ripple or noise in the transmission signals from the other stages, and the power consumption is thereby substantially reduced.

Next, a waveform of signals at various points in the stage of FIG. 3 will be described with reference to FIG. 6.

FIG. 6 is a signal timing diagram showing signals in an exemplary embodiment of a stage of a gate driver according to the invention.

In FIG. 6, a horizontal direction is a time axis, a period 0H is a period, in which the gate-on voltage is output from a stage SR, and a unit time period may be about one horizontal period, for example. In FIG. 6, the gate-on voltage is output from a previous stage during a first previous period −1H, and the gate-on voltage is output from a subsequent stage during a first subsequent period 1H.

In FIG. 6, Q, G-OT and CR indicate the voltage of the node Q, the gate output voltage and the transmission signal CR in the stage, respectively, IVT(n) indicates the inverter signal of the stage as the signal of the node Q' in the stage, IVT n−1 indicates the inverter signal of the previous stage, and IVT n+1 indicates the inverter signal of the subsequent stage.

Hereinafter, the voltage change at the node Q in an exemplary embodiment of the stage will be described. The voltage at the node Q is increased during the first previous period −1H before the gate-on voltage is output from the stage. When the gate-on voltage is output from the stage, the voltage at the node Q is further increased during the period 0H such that the high gate-on voltage is generated.

In such an embodiment, the gate output voltage and the transmission signal CR are both output as the high value based on the voltage at the node Q.

Hereinafter, the inverter signal IVT(n) of the stage will be described. In the stage, the voltage of the node Q' is periodically changed based on the clock signal, the voltage of the node Q' is maintained as a low state, not as the high voltage, during the period 0H when the gate-on voltage is output, as described above, and the voltage of the node Q' has the low value when the node Q is high, such that the signal output from the inverter signal output terminal IVTout is thereby referred to as the inverter signal. In an exemplary embodiment, the inverter signal IVT(n) of the stage has the low level during three horizontal periods, e.g., the period 0H and the first previous and subsequent periods −1H and 1H, which are immediately before and after the period 0H, and high level and low level are alternately output during the periods before and after the three horizontal periods.

In an exemplary embodiment, a inverter signal of the previous stage IVT(n−1) and a inverter signal of the first subsequent stage IVT(n+1) are a signal that is moved by one horizontal period at the left side and the right side with respect to the inverter signal IVT(n) of the stage.

In an exemplary embodiment, as shown in FIG. 3, the stage includes a transistor having a control terminal connected to the node Q' of the stage such that the transistor is controlled based on the inverter signal IVT(n) of the stage and a transistor controlled based on the inverter signal IVT(n−1) of the previous stage.

In such an embodiment, the transistor controlled based on the inverter signal IVT(n) of the current is the third transistor Tr3, the sixth transistor Tr6, and the tenth transistor Tr10 and the sixth and tenth transistors, and the sixth transistor Tr6 and the tenth transistor Tr10 are the dual gate thin film transistors to change the voltage of the node Q to the second low voltage Vss2.

The sixth transistor Tr6 receives the transmission signal CR of the second subsequent stage and the inverter signal IVT(n) of the stage through the third input terminal IN3, and the transmission signal CR of the second subsequent stage is the transmission signal CR having the high value during the period 2H in FIG. 6 such that the transmission signal CR of the second subsequent stage has the same high value as the inverter signal IVT(n) of the stage during a second subsequent period 2H. In an alternative exemplary embodiment, the sixth transistor Tr6 may have a single gate structure since the same voltage is applied to two control terminal sixth transistor Tr6 during the second subsequent period 2H.

Figure 8:
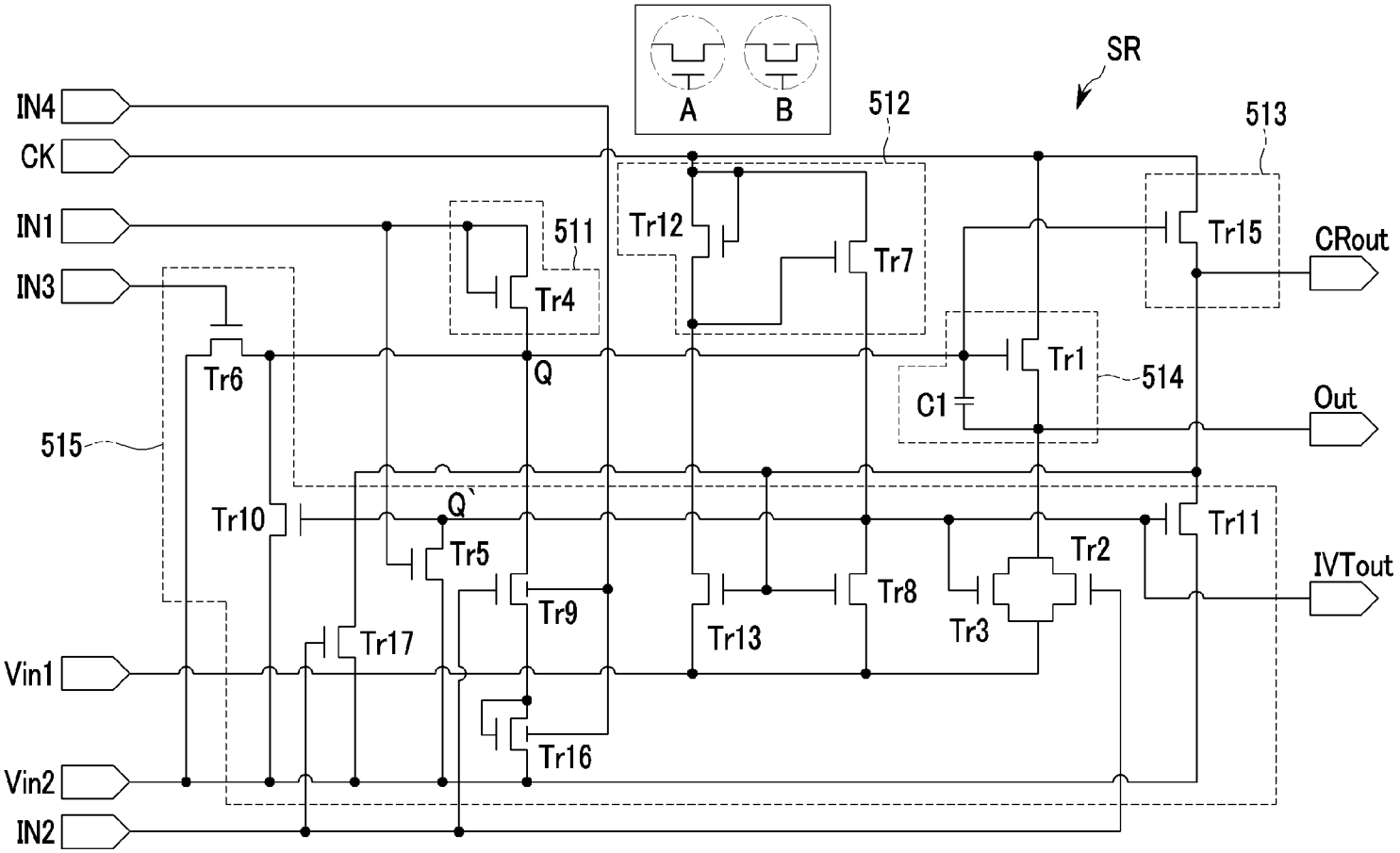
FIG. 8 is a circuit diagram showing an alternative exemplary embodiment of a stage in a gate driver according to the invention.

In an exemplary embodiment, two control terminals of the tenth transistor T10 are applied with the inverter signal IVT (n) of the stage. In an alternative exemplary embodiment, as shown in FIG. 8, the tenth transistor Tr10 may have a single gate structure.

In an exemplary embodiment, the transistors controlled based on the inverter signal IVT(n−1) of the previous stage are the ninth transistor Tr9 and the sixteenth transistor Tr16. The control terminal of the ninth transistor Tr9 receives the transmission signal CR of the first subsequent stage and the inverter signal IVT(n−1) of the previous stage. The transmission signal CR of the first subsequent stage is the transmission signal CR having the high value during the first subsequent period 1H of FIG. 6 such that the control terminal of the ninth transistor Tr9 has the same high value as the inverter signal IVT(n−1) of the previous stage during the first subsequent period 1H. In an exemplary embodiment, the ninth transistor Tr9 has the dual gate structure although the same voltage is applied to the two control terminals of the ninth transistor Tr9 during the first subsequent period 1H such that the ninth transistor Tr9 prevents the gate-on voltage from being delayed in the first subsequent period 1H. In such an embodiment, the gate-on voltage is substantially rapidly changed into the low voltage, and the abnormal operation of the gate driver is thereby effectively prevented.

In an exemplary embodiment, the sixteenth transistor Tr16 has a diode connection structure, in which the second control terminal is applied with the inverter signal IVT(n−1) of the previous stage, and the first control terminal is connected to the input terminal thereof. In an exemplary embodiment, the sixteenth transistor Tr16 executes an auxiliary operation to assist the ninth transistor Tr9. In such an embodiment, the sixteenth transistor Tr16 may be a single gate thin film transistor. In an alternative exemplary embodiment, the sixteenth transistor Tr16 may be omitted from the stage.

Referring to FIG. 6, the transistors that decrease the voltage of the node Q in an exemplary embodiment of the stage in FIG. 3, e.g., the sixth, ninth, tenth and sixteenth transistors Tr6, Tr9, Tr10, and Tr16, are controlled by the inverter signal IVT(n) of the stage as the voltage of the node Q' and the inverter signal IVT(n−1) of the previous stage. However, in FIG. 6, if the inverter signal IVT(n) of the stage and the inverter signal IVT(n−1) of the previous stage are summed, it may be confirmed that they have the high value in all regions except for the period 0H for generating the gate voltage in the stage and the first previous section −1H before the period 0H. In such an embodiment, the level of the gate-on voltage is not decreased during the first previous period −1H and the period 0H for generating the gate voltage, during which the voltage of the node Q is not decreased, while the voltage of the node Q in the stage is changed. In such an embodiment, the voltage of the node Q is lowered to the low voltage Vss2 except during the period 0H and the first previous period −1H such that the gate-on voltage is decreased to the low voltage immediately after the period 0H in which the gate-on voltage is output, and the gate-on voltage is thereby delayed not to have the high level in the first subsequent period 1H.

In an exemplary embodiment, the deterioration of the output level and the delay in the gate-on voltage of the stage are effectively prevented.

In an alternative exemplary embodiment, the inverter signal IVT(n+1) of the first subsequent stage may be input to the fourth input terminal IN4 of the stage shown in FIG. 3. In such an embodiment, the gate-on voltage is output during the period 0H, and a sum of the inverter signal IVT(n+1) of the first subsequent stage and the inverter signal IVT(n) of the stage has the high level during a predetermined period such that the gate-on voltage is not generated during the predetermined period.

The operation of the above-described stage will now be described in greater detail with reference to FIGS. 7A and 7B.

FIGS. 7A and 7B are tables showing an operation characteristic of signals in an exemplary embodiment of a stage of a gate driver according to the invention.

In FIGS. 7A and 7B, the row is corresponding to the time periods that is increased by one horizontal period, and a voltage level (a node Q level) of the node Q in the current stage, the output (a gate-off output) of the gate-off voltage, the output (a carry output) of the transmission signal CR and the output (an inverter output) of the inverter signal IVT(n) are shown in detail.

In FIG. 7, transistors related to the corresponding output in the corresponding section are shown in greater detail. In FIG. 7, G means the control terminal of the transistor, S means the output terminal of the transistor, Carry means the transmission signal CR, CK means the clock signal, Vss1 means the first low voltage Vss1, and Vss2 means the second low voltage Vss2.

In an exemplary embodiment, as shown in FIG. 7, the fourteenth transistor Tr14 may be included in the stage. In an alternative exemplary embodiment, the fourteenth transistor Tr14 may be omitted. In an exemplary embodiment, the fourteenth transistor Tr14 is disposed an end of the gate line and lowers the gate-on voltage to the first low voltage Vss1 based on the gate-on voltage of the first subsequent stage or the transmission signal CR of the first subsequent stage, which are transmitted to the control terminal thereof.

Next, an alternative exemplary embodiment of the stage will be described with reference to FIG. 8.

FIG. 8 is a circuit diagram showing an alternative exemplary embodiment of a stage in a gate driver according to the invention.

The stage shown in FIG. 8 is substantially the same as the exemplary embodiment of the stage shown in FIG. 3, except that the sixth transistor Tr6 and the tenth transistor Tr10. In FIG. 8, the sixth and tenth transistors Tr6 and Tr10 are not the dual gate thin film transistor, and only the ninth transistor Tr9 and the sixteenth transistor Tr16 are the dual gate thin film transistor.

In the illustrated exemplary embodiment of FIG. 8, signals substantially the same as the signals shown in FIG. 6 are generated under the operation of the sixth transistor Tr6 and the tenth transistor Tr10, shown in FIG. 8.

In such an embodiment, the sixth transistor Tr6 receives the transmission signal CR of the second subsequent stage through the third input terminal IN3, and the transmission signal CR of the second subsequent stage has the high value in the second subsequent period 2H in FIG. 6 such that the operation of the sixth transistor Tr6 is substantially the same as the operation of the exemplary embodiment of FIG. 3 during the second subsequent period 2H. In such an embodiment, the control terminal of the tenth transistor Tr10 is connected to the node Q' to receive the inverter signal IVT(n) of the stage such that the operation of the tenth transistor Tr10 in FIG. 8 is substantially the same as the operation of the tenth transistor TR10 in FIG. 3. In such an embodiment, the sixth transistor Tr6 and the tenth transistor Tr10 decrease the voltage of the node Q into the second low voltage Vss2.

In the illustrated exemplary embodiment of FIG. 8, the sixth transistor Tr6 and the tenth transistor Tr10 have the single gate structure, and the circuit structure of the stage is substantially simple.

Hereinafter, the gate-on voltage of an exemplary embodiment of the stage and a gate-on voltage of a conventional stage including transistors having single gate structure will be described with reference to FIGS. 9A to 12.

Figure 9A:
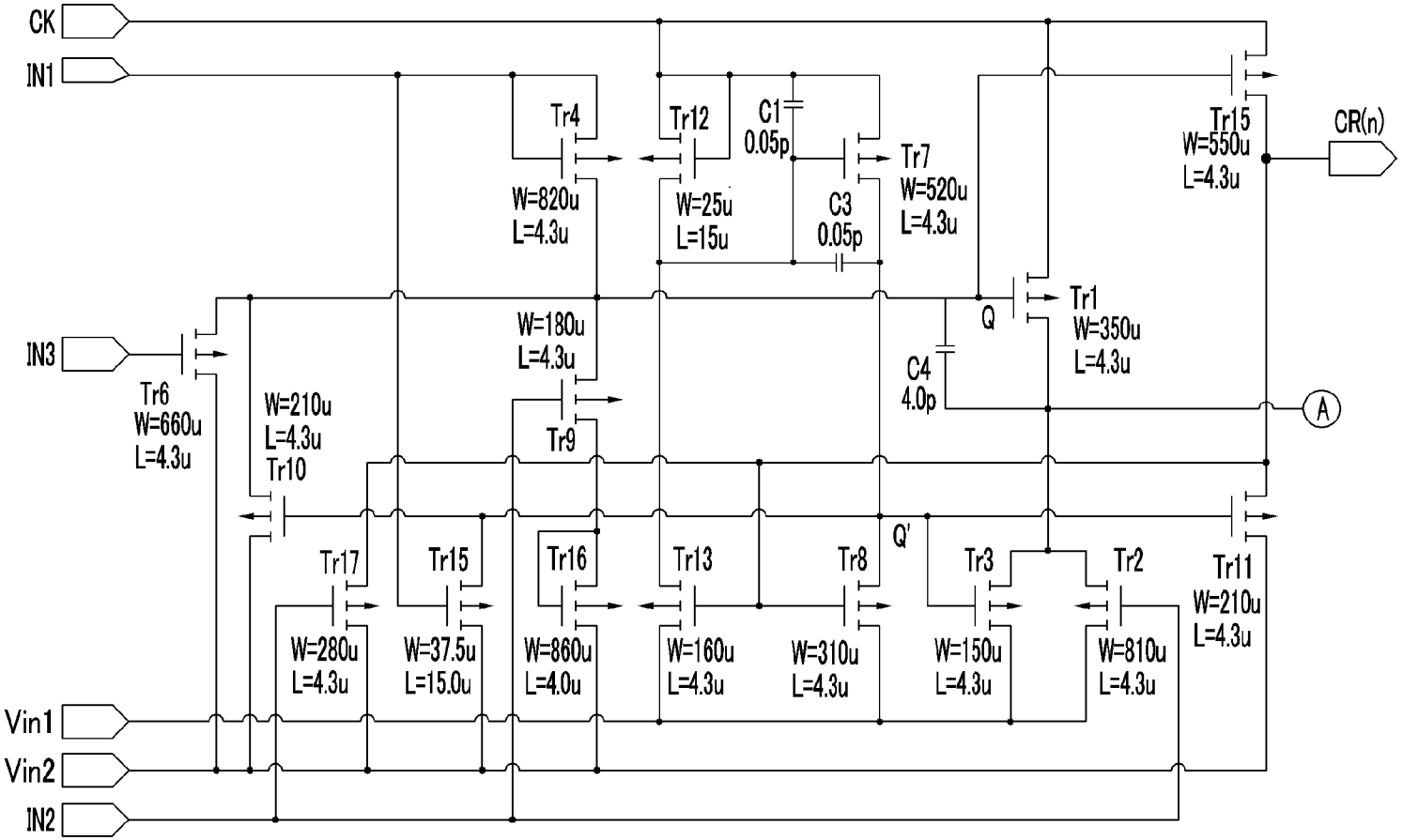
FIGS. 9A to 9B are circuit diagrams showing an exemplary embodiment of the invention.
Figure 9B:
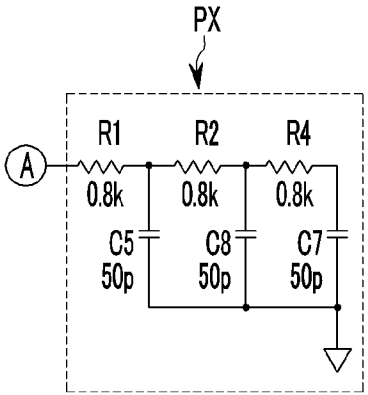
Figure 10:
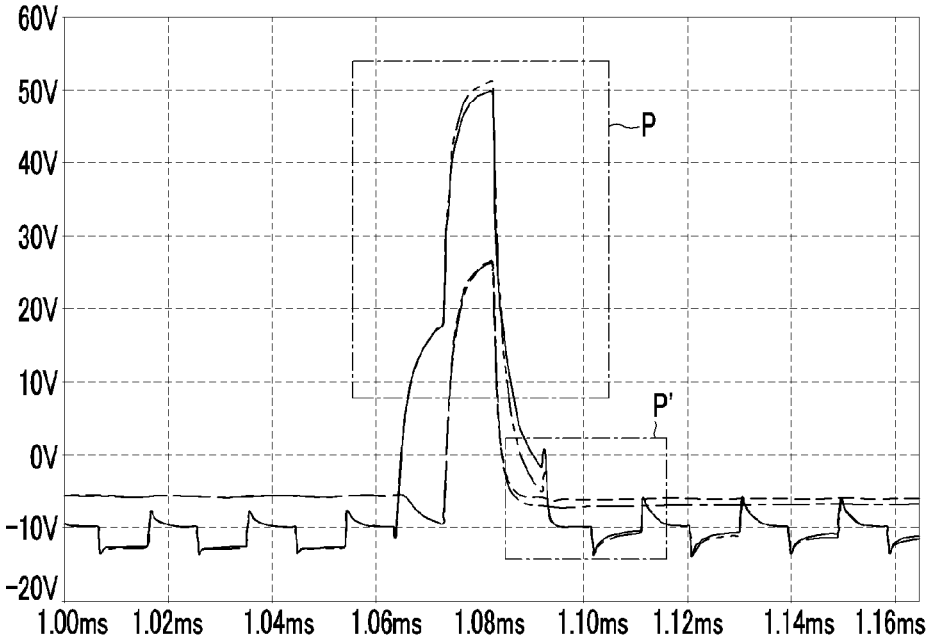
FIGS. 10 to 12 are graphs of voltage (volt) versus time (millisecond) showing a simulation result with reference to an exemplary embodiment of the invention.
Figure 11:
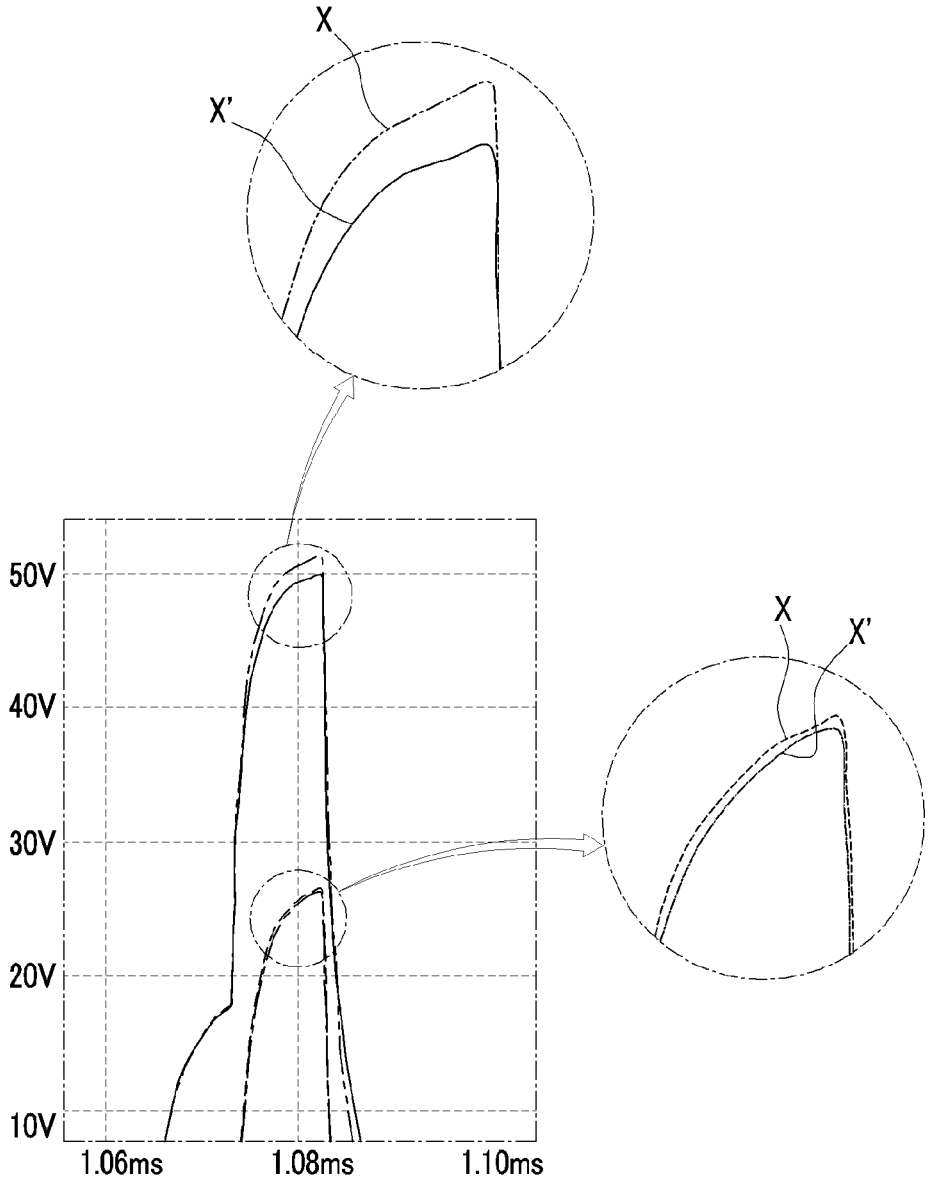
Figure 12:
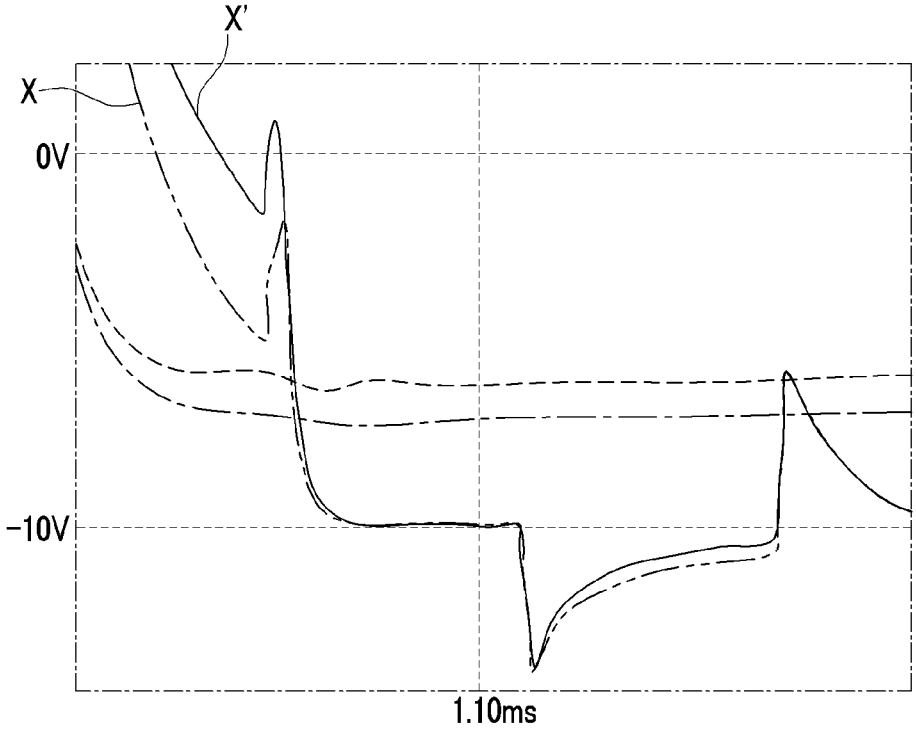

FIGS. 9A to 9B are circuit diagrams showing an exemplary embodiment of the invention, and FIGS. 10 to 12 are graphs of voltage (volt) versus time (millisecond) showing a simulation result with reference to an exemplary embodiment of the invention.

FIGS. 9A and 9B shows the structure used in a simulation, and the size, e.g., a width W and a length L, of each transistor are predetermined as constant values. The pixel PX of the display panel 100 is shown as an equivalent circuit in FIG. 9B, and values shown in the equivalent circuit are used for the simulation. In simulations of the conventional stage and an exemplary embodiment of the stage using the structure of FIG. 9, a threshold voltage of the sixth, ninth, tenth and sixteenth thin film transistors Tr6, Tr9, Tr10 and Tr16 having the dual gate structure in FIG. 3 of the invention is controlled.

In the simulation, the threshold voltage of the sixth, ninth, tenth, and sixteenth thin film transistors Tr6, Tr9, Tr10 and Tr16 is set up as 3.66 volts (V) in the conventional stage, and the threshold voltage of the sixth, ninth, tenth, and sixteenth thin film transistors Tr6, Tr9, Tr10, and Tr16 is changed to 5.66 V when increasing and to 1.66 V when decreasing in the exemplary embodiment of the stage.

The output of the voltage of the node Q and the gate-on voltage in each of the conventional stage and the exemplary embodiment of the stage are shown in FIGS. 10 to 12.

In FIG. 10, a waveform having relatively high maximum voltage level represents the voltage of the node Q, and a waveform having relatively low maximum voltage level represents the gate-on voltage.

FIG. 10 shows the waveforms corresponding to the conventional stage and the exemplary embodiment of the stage, and the enlarged view of the waveforms are described in FIGS. 11 and 12.

FIG. 11 is an enlarged view of a portion P in FIG. 10, and shows the voltages near the maximum level of the voltages of the node Q and the gate-on voltages of the conventional stage and the exemplary embodiment of the stage.

In FIG. 11, X denotes a voltage waveform corresponding to the exemplary embodiment of the invention, and X' denotes a voltage waveform corresponding to the conventional stage. As shown in FIG. 11, a level of the voltage waveform corresponding to an exemplary embodiment of the invention is higher than a level of the voltage waveform corresponding to the conventional stage. In an exemplary embodiment, the leakage generated in the stage is substantially reduced such that a higher voltage is output.

FIG. 12 is an enlarged view of a portion P' in FIG. 10, and FIG. 12 shows whether the voltage and the gate-on voltage of the node Q are rapidly decreased or delayed.

In FIG. 12, X denotes a voltage waveform corresponding to the exemplary embodiment of the invention, and X' denotes a voltage waveform corresponding to the conventional stage. In FIG. 12, the voltage level of the voltage waveform corresponding to the exemplary embodiment of the invention is quickly decreased, and the voltage level of the voltage waveform corresponding to the conventional stage is decreased with delay. When the conventional stage is used for a long time, a problem that the gate-on voltage is partially applied may be generated in the section in which the gate-off voltage must be output. In an exemplary embodiment, the delay of the gate-on voltage is substantially reduced such that the operation of the stage is substantially improved by preventing the partial application of the gate-on voltage during a gate-off period due to the delay of the gate-on voltage.

In an exemplary embodiment, the output control signal OCS may be the inverter signal IVT(n−1) of the previous stage, shown in FIG. 6, for example, but note being limited thereto. In an alternative exemplary embodiment, the output control signal OCS may be various signals, which have a low voltage in the period 0H of FIG. 6 (the period in which the gate-on voltage is output), and have the low voltage during the first previous period −1H.

In an exemplary embodiment, the stage of the gate driver includes the dual gate thin film to be controlled by two control signals such that the output of the gate-on voltage is substantially constant. In an alternative exemplary embodiment, the transistors in the stage other than the sixth, ninth, tenth and sixteenth thin film transistors, which are the dual gate thin film transistors in FIGS. 3 and 8, may be the dual gate thin film transistor. In another alternative exemplary embodiment, only one of the sixth, ninth, tenth and sixteenth thin film transistor may be the dual gate thin film transistor.

While the invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A display panel comprising:

a gate driver connected to a gate line, wherein the gate driver comprises a plurality of stages, wherein each of the stages comprises at least one dual gate thin film transistor having a first control terminal and a second control terminal which respectively receive one of a carry signal of one of the subsequent stages and an inverter signal of the one of the previous stages, and wherein each of the stages receives a clock signal, a first low voltage, a second low voltage, at least one transmission signal of previous stages thereof, at least two transmission signals of subsequent stages thereof and an output control signal from one of the stages to output a gate voltage including a gate-on voltage and a gate-off voltage.

2. The display panel of claim 1, wherein the output control signal has a low voltage during a corresponding period, and a corresponding stage, which receives the output control signal, outputs the gate-on voltage during the period.

3. The display panel of claim 2, wherein the output control signal has the low voltage during a previous period of the corresponding period, and the corresponding stage outputs the gate-on voltage during the previous period.

4. The display panel of claim 1, wherein each of the stages comprises:

an input section;

a pull-up driver;

a pull-down driver;

an output unit; and a transmission signal generator, each of the stages receives the first low voltage and the second low voltage, which is lower than the first low voltage, and outputs the first low voltage as the gate-off voltage, the input section, the pull-down driver, the output unit and the transmission signal generator are connected to a first node, and the pull-up driver and the pull-down driver are connected to a second node, which generates the inverter signal.

5. The display panel of claim 4, wherein the output unit comprises a transistor and outputs the gate-on voltage, a control terminal of the transistor of the output unit is connected to the first node, the at least one dual gate thin film transistor includes a first dual gate thin film transistor, and the first dual gate thin film transistor is connected to the first node.

6. The display panel of claim 5, wherein the output control signal is the inverter signal of one of the previous stages.

7. The display panel of claim 6, wherein a first control terminal of the first dual gate thin film transistor receives the carry signal of one of the subsequent stages, a second control terminal of the first dual gate thin film transistor receives the inverter signal of the one of the previous stages, and an input terminal of the dual gate thin film transistor is connected to the first node.

8. The display panel of claim 7, wherein the at least one dual gate thin film transistor further includes a second dual gate thin film transistor, a first control terminal and an input terminal of the second dual gate thin film transistor are connected to an output terminal of the first dual gate thin film transistor, a second control terminal of the second dual gate thin film transistor receives the inverter signal of the one of the previous stages, and an output terminal of the second dual gate thin film transistor receives the second low voltage.

9. The display panel of claim 5, wherein the output control signal is the inverter signal of a corresponding stage, which receives the output control signal.

10. The display panel of claim 9, wherein an input terminal of the first dual gate thin film transistor is connected to the first node, an output terminal of the first dual gate thin film transistor receives the second low voltage, and a first control terminal and a second control terminal of the first dual gate thin film transistor receive the inverter signal of the corresponding stage.

11. The display panel of claim 10, wherein the at least one dual gate thin film transistor further includes a second dual gate thin film transistor, a first control terminal of the second dual gate thin film transistor receives a transmission signal of one of the subsequent stages, a second control terminal of the second dual gate thin film transistor receives the inverter signal of the corresponding stage, an output terminal of the second dual gate thin film transistor receives the second low voltage, and an input terminal of the second dual gate thin film transistor is connected to the first node.

12. The display panel of claim 1, wherein each of the stages comprises:

a first input terminal;

a second input terminal;

a third input terminal;

a fourth input terminal;

a clock input terminal;

a first voltage input terminal which receives the first low voltage;

a second voltage input terminal which receives the second low voltage, which is lower than the first low voltage;

a gate voltage output terminal which outputs the gate voltage;

a transmission signal output terminal; and an inverter signal output terminal connected to the fourth input terminal of one of the subsequent stages.

13. The display panel of claim 12, wherein each of the stages further comprises:

a first node connected to a control terminal of a thin film transistor thereof, which outputs the gate-on voltage; and a second node, which outputs an inverter signal.

14. The display panel of claim 13, wherein the at least one dual gate thin film transistor includes a first dual gate thin film transistor, a first control terminal of the first dual gate thin film transistor receives a carry signal of the one of the subsequent stages, a second control terminal of the first dual gate thin film transistor receives the inverter signal of one of the previous stages, and an input terminal of the first dual gate thin film transistor is connected to the first node.

15. The display panel of claim 14, wherein the at least one dual gate thin film transistor further includes a second dual gate thin film, a first control terminal and an input terminal of the second dual gate thin film transistor are connected to an output terminal of the first dual gate thin film transistor, a second control terminal of the second dual gate thin film transistor receives the inverter signal of the one of the previous stages, and an output terminal of the second dual gate thin film transistor receives the second low voltage.

16. The display panel of claim 13, wherein at least one dual gate thin film transistor includes a first dual gate thin film transistor, an input terminal of the first dual gate thin film transistor is connected to the first node, an output terminal of the first dual gate thin film transistor receives the second low voltage, and a first control terminal and a second control terminal of the first dual gate thin film transistor receive the inverter signal of a corresponding stage thereof.

17. The display panel of claim 16, wherein at least one dual gate thin film transistor further includes a second dual gate thin film transistor, a first control terminal of the second dual gate thin film transistor receives a transmission signal of another of the subsequent stages, a second control terminal of the second dual gate thin film transistor receives the inverter signal of the corresponding stage thereof, an output terminal of the second dual gate thin film transistor receives the second low voltage, and an input terminal of the second dual gate thin film transistor is connected to the first node.

* * * * *